US005865862A

United States Patent [19]

Hassan

[11] Patent Number: 5,865,862

[45] Date of Patent: Feb. 2, 1999

[54] MATCH DESIGN WITH BURN PREVENTATIVE SAFETY STEM CONSTRUCTION AND SELECTIVELY IMPREGNABLE SCENTING COMPOSITION MEANS

[76] Inventor: Shawky Hassan, 1146 S. Linden, Flint, Mich. 48054

[21] Appl. No.: 909,901

[22] Filed: Aug. 12, 1997

[51] Int. Cl.[6] ..... C06F 3/00; C06F 5/00

[52] U.S. Cl. ..... 44/507; 44/511; 44/512

[58] Field of Search ..... 44/507, 511, 512

[56] References Cited

U.S. PATENT DOCUMENTS

| | | | |
|---|---|---|---|
| 1,780,920 | 11/1930 | Honigbaum | 44/511 |
| 2,160,115 | 5/1939 | Bell | 44/511 |
| 2,163,009 | 6/1939 | Pratt | 44/507 |
| 3,838,989 | 10/1974 | Cohn | 44/511 |
| 4,072,473 | 2/1978 | Rodhowski et al. | 44/511 |
| 4,208,189 | 6/1980 | Ryall et al. | 44/507 |

*Primary Examiner*—Jacqueline V. Howard
*Attorney, Agent, or Firm*—Gifford, Krass, Groh, Sprinkle, Patmore, Anderson & Citkowski, P.C.

[57] ABSTRACT

A match design exhibiting burn preventative safety stem construction with a match head having an ignitable composition formed thereon. An elongate stem includes a first end and a second end with the match head being formed onto the first end. The elongate stem is subdivided into a first section extending a selected distance from the first end. A second section extends beyond the first section a further selected distance and terminates in the second end. The first section is impregnated with a scenting composition and the second section is impregnated with a flame resistant composition such that, upon striking and ignition of the match head, flame travel along the stem is limited to the first section to release the scenting composition.

5 Claims, 3 Drawing Sheets

10
12
14
2
2

10
18
14
16
12
FLAME RETARDANT
SCENTING COMPOUND
36
38
22
20
SAWDUST
BINDER 42
40
30
44
26
24
29
28
34
32
38
36
20,22
FLAME RETARDANT
SAWDUST & BINDER
SCENTING

MATCH DESIGN WITH BURN PREVENTATIVE SAFETY STEM CONSTRUCTION AND SELECTIVELY IMPREGNABLE SCENTING COMPOSITION MEANS

BACKGROUND OF THE INVENTION

1. Field of the Invention

The present invention relates generally to matchbook and wooden match constructions and, more particularly, to an improved match design with burn preventative safety stem construction and a selectively impregnable scenting composition means.

2. Description of the Prior Art

The prior art is well documented with examples of matches and match book constructions. An example of a prior art match construction is taught by U.S. Pat. No. 4,610,694, issued to Krusche, which teaches a match having a scent compound incorporated into the igniting head of the match. A first layer of the match head includes an adsorbent, a scenting compound and/or deodorant and a binder. A second layer consisting of an igniting composition is applied over the first layer and the match head, upon being struck against an appropriate surface, ignites to release the underlying scenting composition.

U.S. Pat. Nos. 4,138,225 and 4,040,879, both issued to Nagatugi et al., disclose examples of match head constructions in which the sulfur component, normally associated with conventional match heads, is replaced with a cellulose nitrate solution. Nagano teaches that replacing a sulfur solution with a cellulose nitrate solution avoids the sulfur and pine resins previously used as combustion agents and likewise reduces the use of potassium chlorate as an ignition agent. The net effect of this is said to result in better combustion of match heads with cellulose nitrate construction and to reduce the amount of soot and smoke associated with lighting the match.

SUMMARY OF THE PRESENT INVENTION

The present invention is a match design which exhibits burn preventative safety stem construction. A match head is provided with an ignitable composition such as a cellulose nitrate or sulfur based composition as is known in the art. An elongate stem includes a first end and a second end, the match head being secured to the first end. The elongate stem is subdivided into a first section extending a selected distance from the first end and a second section extending beyond the first section a further selected distance and terminating in the second end. In one variant the stem is provided as a single elongate member and in a further variant the first and second sections of the stem form first and second individual and elongate pieces which are assembled together.

In a first preferred embodiment, the stem is constructed of a sawdust based composition and which is compressed into the desired elongate shape with the assistance of an appropriate binder material. The stem may further include an elongate spine around which the sawdust and binder are formed and the spine may be of a like wooden, polymer or metallic construction as is desired. It is also envisioned that the stem construction can be provided as an existing elongate and thin wooden stick having an appropriate cross section.

The first section of the elongate stem is impregnated with a desired scenting composition and the second section is impregnated with a flame resistant composition. Upon striking and ignition of the match head, flame travel along the stem is limited to the first section to release the scenting composition and is terminated upon contact with the second section.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
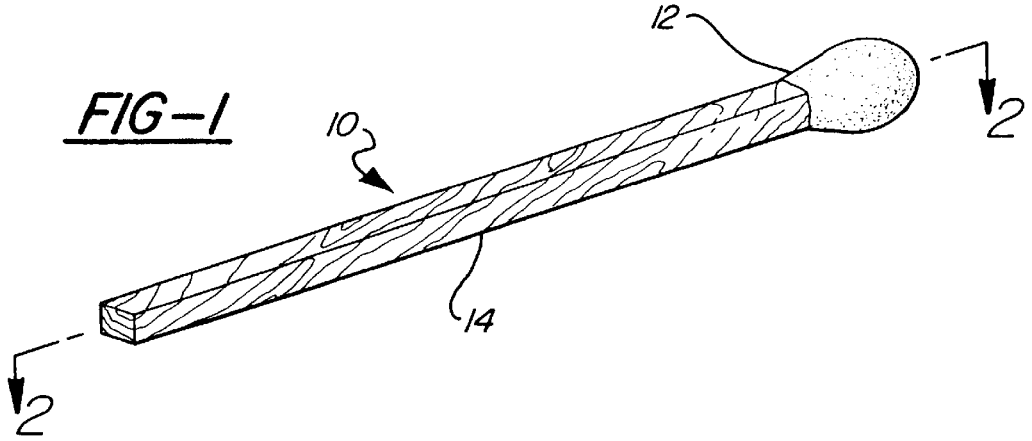
FIG. 1 is a perspective view of a match design exhibiting scenting and flame resistant compositions according to a first preferred embodiment of the present invention.

Referring now to FIG. 1, a match design 10 is shown according to a first preferred embodiment of the present invention and includes a match head 12 secured to an elongate stem 14 at a first end thereof. The match head 12 is typically dipped into a wet paste of chemicals which includes a binder such as an animal hide glue, a fuel such as cellulose nitrate or sulfur as is also taught in the prior art, and an oxidizing agent such as potassium chlorate to provide oxygen for burning and a diluent such as starch or finely ground sand to adjust the burning rate and to provide the match head with additional bulk. It is desirable to utilize a match head construction which does not give off any scenting during initial ignition and combustion but only during subsequent burning off of the stem for purposes which will be subsequently described.

Figure 2:
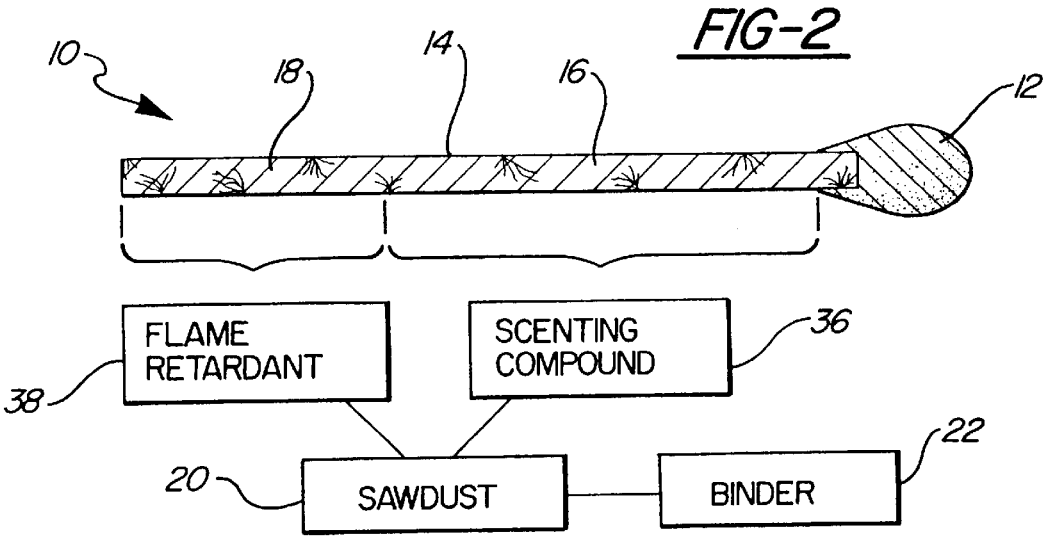
FIG. 2 is a cutaway taken along line 2—2 of FIG. 1 and further illustrating the compressed sawdust and binder elements which are combined with the scenting and flame retardant compositions, respectively, for producing the match design according to the present invention.

Referring now to FIG. 2, a cutaway view is shown of the match head 10 and which further illustrates the manner in which the elongate stem 14 is constructed according to the first preferred embodiment of the present invention. In each of the preferred embodiments, the stem 14 is subdivided into a first section 16 to which the match head 12 is mounted and a second section 18 which is connected in some fashion to the first section 16 and extends rearwardly to a second end thereof of the overall stem 14. The stem 14 also can exhibit any desirable polygonal cross sectional shape ranging between a triangle with three associated sides to a circle having an infinite number of sides, but is preferably a square shape as is well known in the art.

Figure 2A:
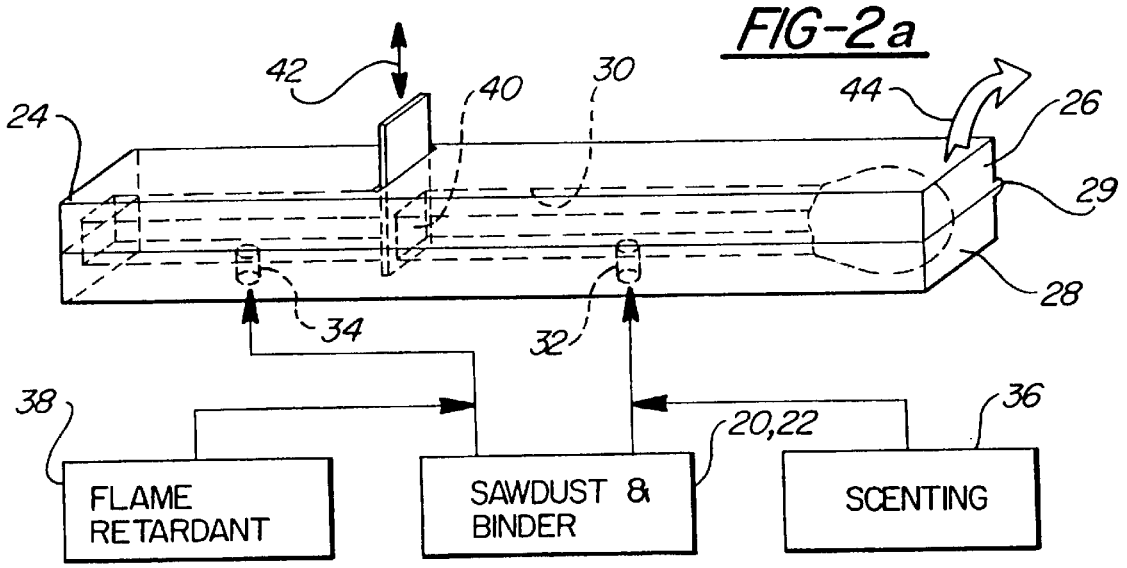
FIG. 2*a* is a view of a mold assembly for compress forming a match design according to the present invention.

In the initial preferred embodiment, the overall match stem 14 is constructed of a finely ground sawdust 20 and an appropriate binder element 22 which are mixed together and then, referring to FIG. 2*a*, are compressed into a match stick shape within an appropriately configured mold cavity 24. A single mold cavity 24 is illustrated in the view of FIG. 2*a*, however it is understood that a large plurality of individually shaped cavities are arranged in banks and in operative engagement with the filler compositions. The construction of the mold can be of any desired rigid and pressure resistant material with a first upper half 26, a second lower half 28, the halves typically being hingedly connected together at 29 in one desired embodiment and further including an interior cavity 30 which is a negative shape of the match design.

The sawdust and binder elements 20 and 22 are pressure injected molded within the mold cavity 30 though inlet apertures 32 and 34 which communicate with forward and rearward positions of the match stem, respectively. A scenting composition is illustrated schematically at 36 is provided by a powderized material corresponding to a desired appealing fragrance or scent such as pine, floral or any other aroma which it is desirable to circulate. The scenting composition 36 is intended to be mixed with the sawdust and binder elements 20 and 22 and introduced through inlet aperture 32 to permeate the forward ⅔ portion of the overall length of the stem 14 which is associated with the desired overall length of the first section 16.

A flame retardant composition is illustrated schematically at 38 and is likewise provided as a powderized composition intended to be mixed with the sawdust and binder elements 20 and 22 and introduced through inlet aperture 34 to permeate approximate the rearward ⅓ portion of the overall length of the stem 14 which is associated with the desired overall length of the second section 18. The process of forming a match 10 according to the present invention contemplates in a first variant timing the injection of the sawdust and binder elements 20 and 22 precisely with the intermixed scenting 36 and flame retardant 38 compositions to independently fill the forward ⅔ and rearward ⅓ lengths of the cavity 30 and so that the scenting and flame resistant compositions do not intermix beyond contacting one another at a boundary between the first and second stem sections.

A further possible variant of the forming process further contemplates the use of a gate 40 which is actuable in a direction as illustrated at 42, the gate 40 capable of being dropped into the cavity 30 to prevent either the scenting composition or flame resistant composition from filling outside its associated stem portion associated with the first and second sections. As some element of pressure and heat are normally associated with forming the compressed matchstick, the gate 40 can be left in place during filling of both the scenting and flame retardant portions and can then be subsequently removed to permit the forming sections of the match stick to then bind and harden in end to end fashion.

Upon sufficient hardening and/or drying of the matchstick to be produced, the mold 24 is opened, such as by pivoting the upper halve 26 about the lower halve 28 in the manner illustrated by directional arrow 44 to permit removal of the matchstick. The match 10 is constructed so that, upon the head 12 being ignited, the flame produced will travel only along the first section 16 to give off the desired scenting and will terminate at the boundary with the second section 18 where the flame retardant is located. It is also understood that the mold assembly 24 may be utilized to produce any matchstick according to the further preferred embodiments of the present invention.

Figure 3:
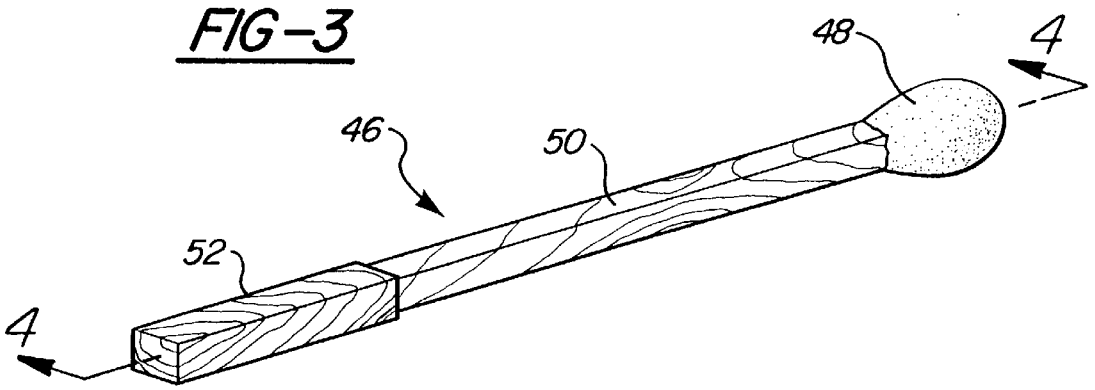
FIG. 3 is a perspective view of a match design according to a second preferred embodiment in which first and second sections of the elongate stem are separable according to the present invention.
Figure 4:
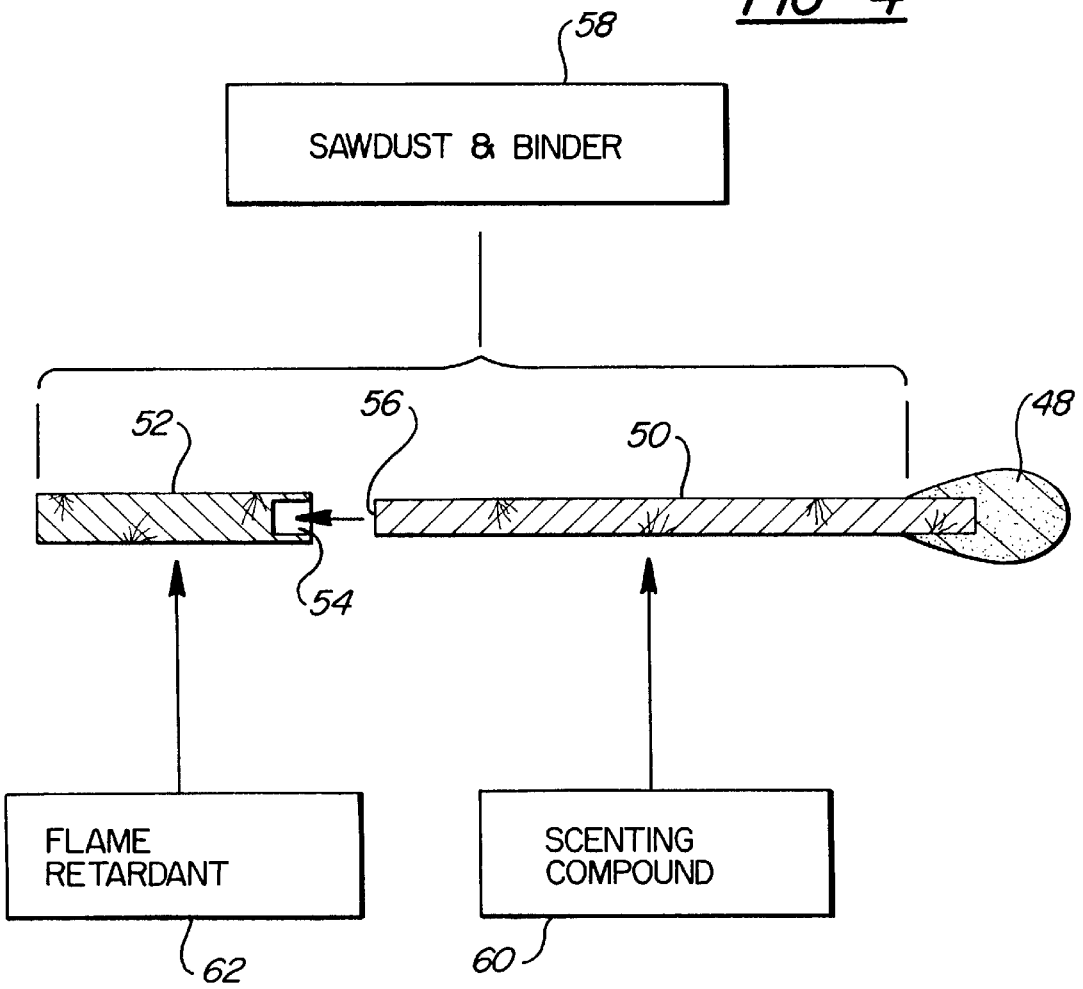
FIG. 4 is a cutaway view taken along line 4—4 of FIG. 3 and further illustrating the axially separable aspects of the first and second elongate stem sections and the separate application of the scenting and flame retardant compositions according to the present invention.

Referring now to FIGS. 3 and 4, a match design 46 is shown according to a further preferred embodiment of the present invention and includes a similarly configured match head 48 with an elongate stem constructed with a first section 50, at the end of which is formed the match head 48, and a second section 52. The second section 52 includes a forwardly facing and interiorly recessed end 54 which is engaged by an opposing and inserting end 56 of the first section 50 for assembling the first and second sections of the matchstick together.

The match design according to embodiment 46 is, in the preferred embodiment, produced by a mold assembly similar to that which is illustrated in FIG. 2*a* which is modifiable to permit the subsections of the matchstick corresponding to the first section with match head and second attachable rearward section to be individually produced. Referring again to FIG. 4, the sawdust and binder composition is shown at 58 for separably mixing with a scenting composition 60 to form the first section 50 of the matchstick and with a flame retardant composition 62 to form the second section 52. As the first and second sections 50 and 52 are formed as individual pieces which are desirable to be secured together, it is further desirable that the inserting end 56 of the first section 50 be engaged within the interior recessed cavity 54 of the second section 52 prior to the segments drying in order to obtain firmer bonding therebetween. The match design 46 exhibits an advantage of having a larger second section 52 to facilitate gripping of the match. As with the first preferred match embodiment 10, the design of the present invention is an improvement in that it the fragrancing and flame retardant are limited to their respective stem sections, thus reducing the amount of the respective elements which are required and resulting in a more economically produced matchstick.

Figure 5:
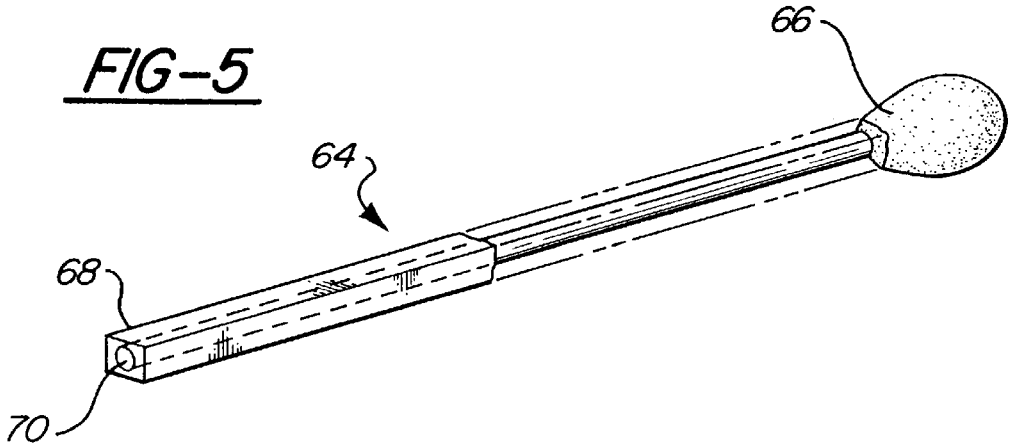
FIG. 5 is a perspective view of a match design according to a third preferred embodiment in which a spine portion is embedded within the elongated stem and over which is compressingly formed the sawdust and binder along with the respective scenting and flame retardant compositions according to the present invention.

Referring now to FIG. 5, a match design 64 is shown according to a further preferred embodiment and includes a match head 66 formed onto an end of an elongate stem 68. An elongate spine 70 is embedded within the stem 68 and typically is provided by a wood, plastic or metal element around which the sawdust and binder compositions are formed. The spine portion 70 may typically be arrayed within a mold cavity prior to introduction of the sawdust, binder and respective scenting and flame retardant elements. The scenting and flame resistant compounds are likewise formed in mixed fashion with the sawdust and binder as taught in the first preferred embodiment to separate the stem 68 into first and second respective sections.

Figure 6:
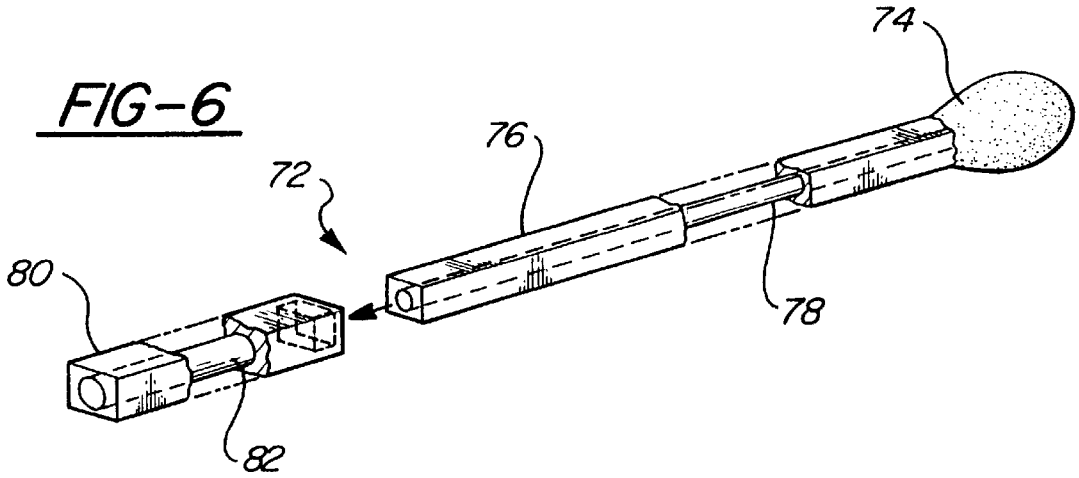
FIG. 6 is a view similar to that shown in FIG. 5 and further illustrating the axially separable aspects of the first and second elongate stem sections according to the further preferred embodiment of the present invention.

Referring to FIG. 6, a further variant 72 of the match design is shown which is largely similar to the earlier embodiment illustrated in FIGS. 3 and 4 with a match head 74 and a stem, with the exception that a first section 76 includes a first interior spine portion 78 and a second section 80 includes a second interior spine portion 82. The variant 72 of the match design provides the same advantages as the design 46 shown in FIGS. 3 and 4 with the exception of the spine portions 78 and 82 adding extra strength to the design.

Figure 7:
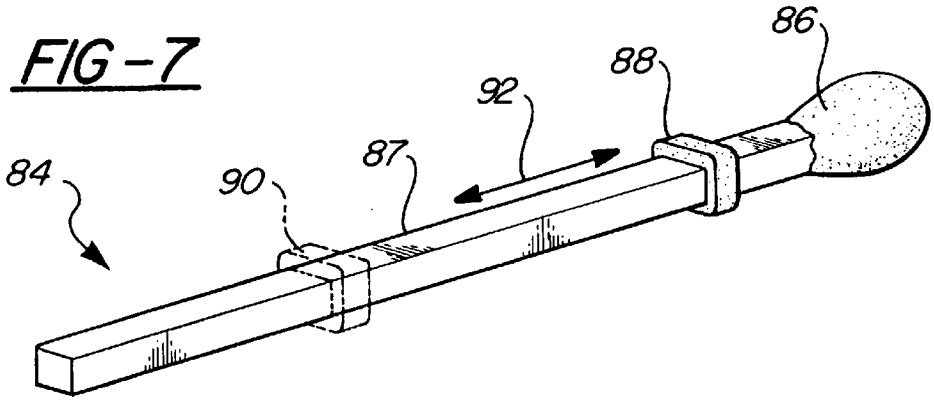
FIG. 7 is a perspective view of a match design according to a fourth preferred embodiment of the present invention and illustrating a flame resistant ring portion secured about a circumference of the elongate stem at a specified axial location which separates the stem into first and second sections to limit the extent of flame travel along the stem.

Referring finally to FIG. 7, a further variant of the match design is shown at 84 and includes a match head 86 formed at an end of a match stem 87 as previously described. Flame resistant protection is provided at a desired location along the stem 87 by a flame resistant/flame limiting ring portion 88 which is secured at a desired axial location around a circumference of the stem 87. The ring portion 88 is constructed of a desired flame resisting material and functions to limit the extent of flame travel to a point desired along the stem 87. The ring is further movable in axial fashion to a further selected location shown in phantom at 90 and along the stem as illustrated by directional arrow 92. While it is preferable in one embodiment to include scenting at a location forward of the flame resistant ring 88, 90, another preferred embodiment provides only the ring to limit the extent of flame travel along the match stem 87.

As is established by the preceding disclosure, it is evident that the present invention teaches an improved match design for providing the release of a scenting composition in controlled fashion along a first selected length of the stem of the matchstick, following which a flame retardant associated with a second subsequent length of the stem prevents further flame travel as a safety feature to the user. The release of the scenting which is made possible by the present invention is further an improvement over scented matches according to the prior art which only release scenting in the head portion of the match and do not provide a more even and controlled scent release such as is provided for by the present invention. The lengths of both the overall stem and the first and second sections can further be adjusted as desired without departing from the scope of the present invention.

Additional preferred embodiments will become apparent to those skilled in the art to which it pertains without deviating from the scope of the appended claims.

I claim:

1. A match design exhibiting burn preventative safety stem construction and comprising:

a match head having an ignitable composition formed thereon;

an elongate stem having a first end and a second end, said match head being connected to said first end, said elongate stem being subdivided into a first section extending a selected distance from said first end, a second section extending beyond said first section a further selected distance and terminating in said second end, said first section and said second section of said elongate stem further including a compressed sawdust and a binder, said first and second sections each further including an elongate spine around which said sawdust and binder are applied, said first section being impregnated with a scenting composition and said second section being impregnated with a flame resistant composition, said first and second sections of said stem further comprising first and second separable portions, said second section including an interiorly recessed end which is engaged by an inserting end of said first section for assembling said first and second sections in end-to-end fashion; and flame resistant means separating said second section from said first section such that, upon striking and ignition of said match head, flame travel along said stem is limited to said first section.

2. The match design as described in claim 1, said first section and said second section of said elongate stem each further comprising a compressed sawdust and binder, a first elongate spine portion being embedded within said first section and a second elongate spine portion being embedded within said second section.

3. The match design as described in claim 1, said elongate spine further being constructed from a material selected from a group including wood, polymer and metal.

4. A match design exhibiting burn preventative safety stem construction and comprising:

a match head having an ignitable composition formed thereon;

an elongate stem having a first end and a second end, said match head being formed onto said first end, said elongate stem being subdivided into a first section extending a selected distance from said first end, a second section extending beyond said first section a further selected distance and terminating in said second end;

said first section being impregnated with a scenting composition;

said second section being impregnated with a flame resistant composition such that, upon striking and ignition of said match head, flame travel along said stem is limited to said first section to release said scenting composition and said first section and said second section of said elongate stem further including an elongate spine around which a compressed sawdust and a binder are applied.

5. A match design exhibiting burn preventative safety stem construction and comprising:

a match head having an ignitable composition formed thereon;

an elongate stem having a first end and a second end, said match head being connected to said first end, said elongate stem being subdivided into a first section extending a selected distance from said first end, a second section extending beyond said first section a further selected distance and terminating in said second end; and flame resistant means separating said second section from said first section such that, upon striking and ignition of said match head, flame travel along said stem is limited to said first section, said flame resistant means further including a flame resistant ring portion secured about a circumference of said elongate stem and at a specified axial location.

* * * * *